US007044029B1

(12) United States Patent
Hopper, Jr. et al.

(10) Patent No.: US 7,044,029 B1
(45) Date of Patent: May 16, 2006

(54) RATCHETING TOOL WITH PAWL SPRING RETAINER

(75) Inventors: Richard L. Hopper, Jr., Kenosha, WI (US); Dennis M. Rockwell, Kansasville, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/879,834

(22) Filed: Jun. 28, 2004

(51) Int. Cl.
*B25B 13/46* (2006.01)

(52) U.S. Cl. ..... 81/60; 81/63.2

(58) Field of Classification Search ..... 81/60–63.2
See application file for complete search history.

(56) References Cited

U.S. PATENT DOCUMENTS

| | | | | |
|---|---|---|---|---|
| 810,599 | A | 1/1906 | Ansorge | |
| 3,044,591 | A | 7/1962 | Kilness | |
| 3,641,847 | A | 2/1972 | Horton | |
| 3,742,787 | A | 7/1973 | Whiteford | |
| 3,783,703 | A | 1/1974 | Trimble et al. | |
| 3,786,698 | A | 1/1974 | Diehl et al. | |
| 4,063,626 | A | 12/1977 | Solomon | |
| 4,257,507 | A | 3/1981 | Solomon | |
| 4,259,883 | A | 4/1981 | Carlson | |
| 4,407,175 | A | 10/1983 | Graham | |
| 4,515,044 | A | 5/1985 | Harstad | |
| 4,631,990 | A * | 12/1986 | Hughes | 81/62 |
| 4,991,468 | A | 2/1991 | Lee | |
| 5,197,358 | A | 3/1993 | Hsu | |
| 5,582,081 | A | 12/1996 | Lin | |
| 5,636,557 | A * | 6/1997 | Ma | 81/60 |
| 5,687,623 | A * | 11/1997 | Hsieh | 81/60 |
| 6,044,731 | A | 4/2000 | Hsieh | |
| 6,101,901 | A | 8/2000 | Daigle | |
| 6,155,140 | A | 12/2000 | Tsai | |
| 6,205,889 | B1 | 3/2001 | Hsieh | |
| 6,220,123 | B1 | 4/2001 | Chen | |
| 6,263,767 | B1 | 7/2001 | Hu | |
| 6,282,991 | B1 | 9/2001 | Hu | |
| 6,282,992 | B1 | 9/2001 | Hu | |
| 6,289,771 | B1 | 9/2001 | Hsieh | |
| 6,301,998 | B1 | 10/2001 | Hu | |
| 6,301,999 | B1 | 10/2001 | Garg | |
| 6,305,247 | B1 | 10/2001 | Chen | |
| 6,332,520 | B1 | 12/2001 | Costin | |
| 6,334,373 | B1 | 1/2002 | Hsieh | |
| 6,341,543 | B1 | 1/2002 | Hsieh | |
| 6,357,323 | B1 | 3/2002 | Chi et al. | |
| 6,382,051 | B1 | 5/2002 | Chang | |
| 6,397,705 | B1 * | 6/2002 | Hsieh | 81/63.1 |
| 6,446,530 | B1 | 9/2002 | Chang | |
| 6,450,068 | B1 | 9/2002 | Hu | |
| 6,457,388 | B1 | 10/2002 | Chen | |
| 6,460,431 | B1 | 10/2002 | Chen | |
| 6,467,378 | B1 | 10/2002 | Chen | |

(Continued)

FOREIGN PATENT DOCUMENTS

| | | |
|---|---|---|
| TW | 281946 | 7/1996 |

(Continued)

*Primary Examiner*—David B. Thomas
(74) *Attorney, Agent, or Firm*—Seyfarth Shaw LLP

(57) ABSTRACT

A ratchet tool has a ratchet body with a cavity therein and a ratchet gear and a pawl disposed in the cavity and a bias spring disposed for resiliently urging the pawl into engagement with the gear, and a retaining member disposed in a recess formed in one or the other of the body and the gear and engaging the spring for retaining it in place.

19 Claims, 2 Drawing Sheets

U.S. PATENT DOCUMENTS

| | | | | |
|---|---|---|---|---|
| 6,481,315 | B1 | 11/2002 | Chang et al. | |
| 6,488,136 | B1 | 12/2002 | Chang | |
| 6,499,380 | B1 | 12/2002 | Hsiao | |
| 6,513,409 | B1 | 2/2003 | Lee | |
| 6,516,930 | B1 | 2/2003 | Chen | |
| 6,530,296 | B1 | 3/2003 | Liao | |
| 6,591,717 | B1 * | 7/2003 | Wei | 81/60 |
| 6,591,718 | B1 | 7/2003 | Chang | |
| 6,644,147 | B1 | 11/2003 | Huang | |
| 6,647,832 | B1 | 11/2003 | Hu | |
| 6,748,825 | B1 * | 6/2004 | Hsu | 81/60 |
| 2003/0041697 | A1 | 3/2003 | Hsien | |
| 2003/0051583 | A1 * | 3/2003 | Lin | 81/60 |
| 2003/0213342 | A1 * | 11/2003 | Wu | 81/60 |

FOREIGN PATENT DOCUMENTS

| | | |
|---|---|---|
| TW | 291727 | 11/1996 |
| TW | 310648 | 7/1997 |
| TW | 323572 | 12/1997 |
| TW | 335750 | 7/1998 |
| TW | 339720 | 9/1998 |
| TW | 347736 | 12/1998 |
| TW | 378588 | 1/2000 |
| TW | 391331 | 5/2000 |
| TW | 398372 | 7/2000 |
| TW | 414120 | 12/2000 |
| TW | 421106 | 2/2001 |
| TW | 428514 | 4/2001 |
| TW | 429844 | 4/2001 |
| TW | 431260 | 4/2001 |
| TW | 443181 | 6/2001 |
| TW | 443182 | 6/2001 |
| TW | 454636 | 9/2001 |
| TW | 468541 | 12/2001 |
| TW | 493495 | 7/2002 |
| TW | 519016 | 1/2003 |
| TW | 530719 | 5/2003 |
| TW | 530721 | 5/2003 |

* cited by examiner

RATCHETING TOOL WITH PAWL SPRING RETAINER

BACKGROUND

This application relates to hand tools and, specifically, to ratcheting tools, such as wrenches or the like, provided with a ratchet mechanism. The application relates in particular to techniques for retaining the pawl spring of a ratchet mechanism.

Various types of ratchet mechanisms for hand tools are known. Such mechanisms typically include a head or a body which carries or defines a gear adapted to be coupled to a fastener or other workpiece for rotation thereof. The ratchet mechanism is typically provided with one or more pawls engageable with the gear teeth for either driving engagement therewith or ratcheting movement relative thereto, depending upon the direction of rotation of the head. The pawl or pawl assembly is biased into engagement with the gear by a suitable bias mechanism, and various types of retaining mechanisms have been provided for retaining the bias mechanism in place.

The bias and retention mechanisms are frequently complicated and difficult to assemble and/or to machine, adding to the cost of the tool.

SUMMARY

There is disclosed in this application a ratchet tool which avoids the disadvantages of prior tools, while affording additional structural and operating advantages.

An aspect of the disclosed tool is the provision of a pawl bias retention technique which is of relatively simple and economical construction.

In an embodiment, a ratchet tool includes a ratchet body having a cavity therein, a ratchet gear disposed in the cavity, a pawl disposed in the cavity for engagement with the gear, a bias spring disposed for resiliently urging the pawl into engagement with the gear, a recess formed in one of the body and the gear, and a retaining member disposed in the recess and engaging the spring for retaining the spring in place.

Also in an embodiment, in a ratchet tool having a body with a cavity and ratchet gear and a pawl disposed in the cavity for engagement with each other and a bias spring disposed in the cavity, there is provided a clip disposed in the cavity around the gear for engagement with the bias spring to hold the bias spring against the pawl for resiliently biasing the pawl into engagement with the gear.

There is also disclosed a method of retaining a pawl spring in a ratchet tool having a body with a cavity therein and a ratchet gear disposed in the cavity, the method comprising providing a recess in one of the body and the gear, and disposing a retaining member in the recess in engagement with the spring for holding the spring against the pawl to resiliently urge the pawl into engagement with the gear.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figures 1, 2:
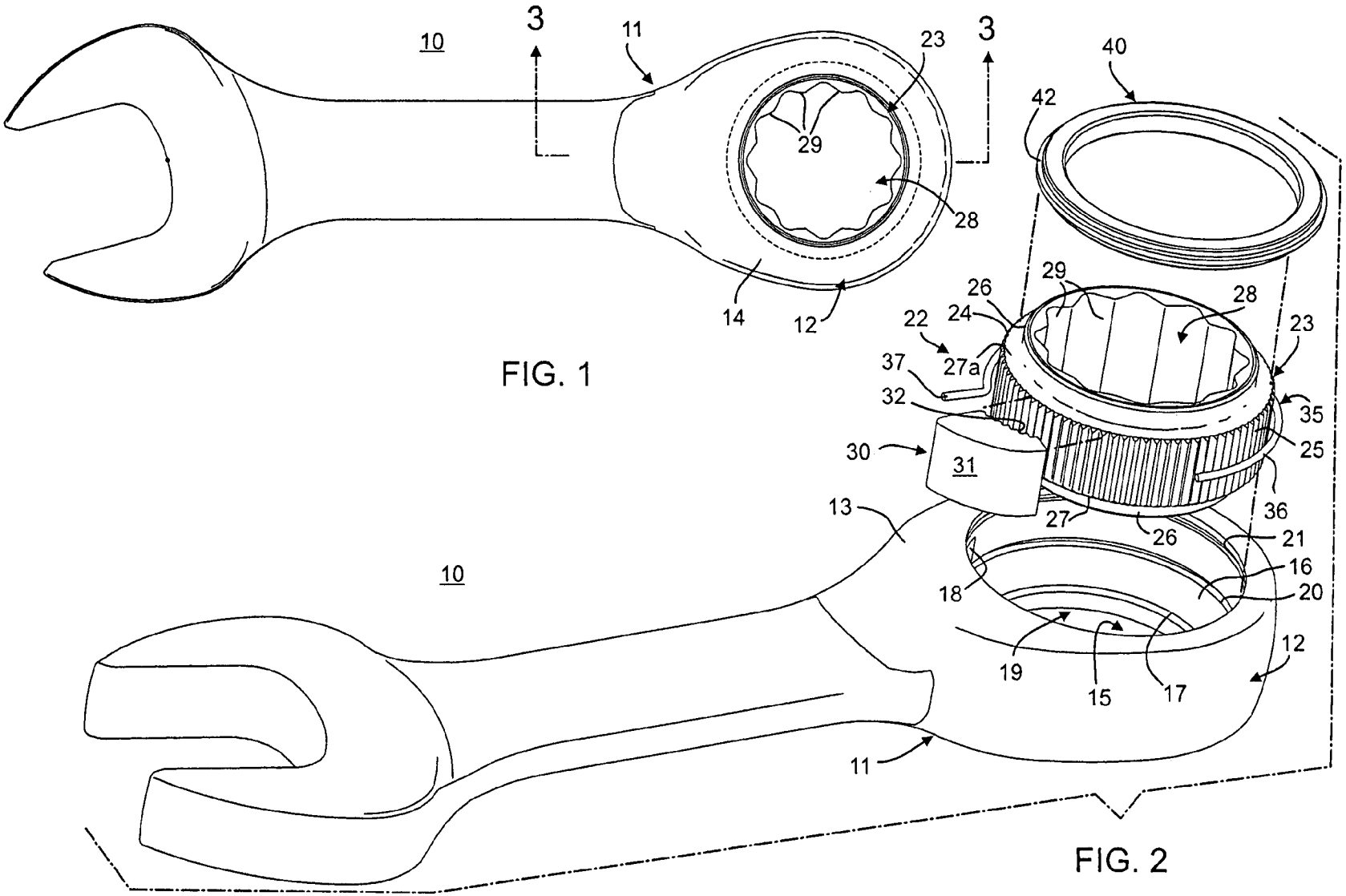
FIG. 1 is a top plan view of a ratchet tool in the form of an end wrench having a ratchet head.
FIG. 2 is an inverted, exploded, perspective view of the wrench of FIG. 1.

Referring to the drawings, there is illustrated a ratchet tool in the form of an end wrench 10 having a ratchet head 11 at one end thereof and being provided with an open-end wrench head at the opposite end thereof, the ratchet head 11 being in the form of a ratcheting box end. While the ratchet head 11 is shown in the form of a ratcheting box end on an end wrench, this is simply for purposes of illustration, and it will be appreciated that the ratchet head could be provided on other types of wrenching tools, and ratchet heads in forms other than a box end could also be provided. While the ratchet head 11 is illustrated as being integral with the wrench 10, it will be appreciated that it could also be movable or indexable relative to the wrench handle in a known manner.

The ratchet head 11 has a body 12 with opposed end faces 13 and 14. Formed through the body 12 from the end face 13 to the end face 14 is a circular bore 15, having a counterbore 16 which defines an annular shoulder 17. Also formed in the body 12 adjacent to the wrench handle is a generally part-cylindrical lobe 18, which communicates with the counterbore 16 for cooperation therewith and with the bore 15 to define a cavity 19. Also formed in the inner surface of the body 12 intermediate the end faces 13 and 14 and communicating with a cavity 19 is a recess in the form of a part-circular groove 20. Also formed in the inner surface of the body adjacent to the end face 13 is a circular groove 21.

Disposed in the cavity 19 is a ratchet mechanism 22 including an annular gear 23 having a cylindrical body 24 provided with external, circumferentially spaced and axially extending teeth 25. Projecting axially from the opposite ends of the body 24 is a reduced-diameter cylindrical hub 26, which cooperates with the body to define a pair of annular shoulders 27 and 27*a*. Extending axially through the gear 23 is a bore 28 defining a plurality of drive surfaces 29. While the drive surfaces 29 are illustrated as arranged in a 12-point configuration, it will be appreciated that other drive configurations could be provided, such as hexagonal, double-hex, square and the like. The gear 23 is dimensioned to fit in the cavity 19, with the lower end of the hub 26 disposed in the bore 15 and the body 24 disposed in the counterbore 16 with the lower shoulder 27 engageable with the shoulder 17, so that the gear 23 is freely rotatable relative to the body 12.

Figure 4:
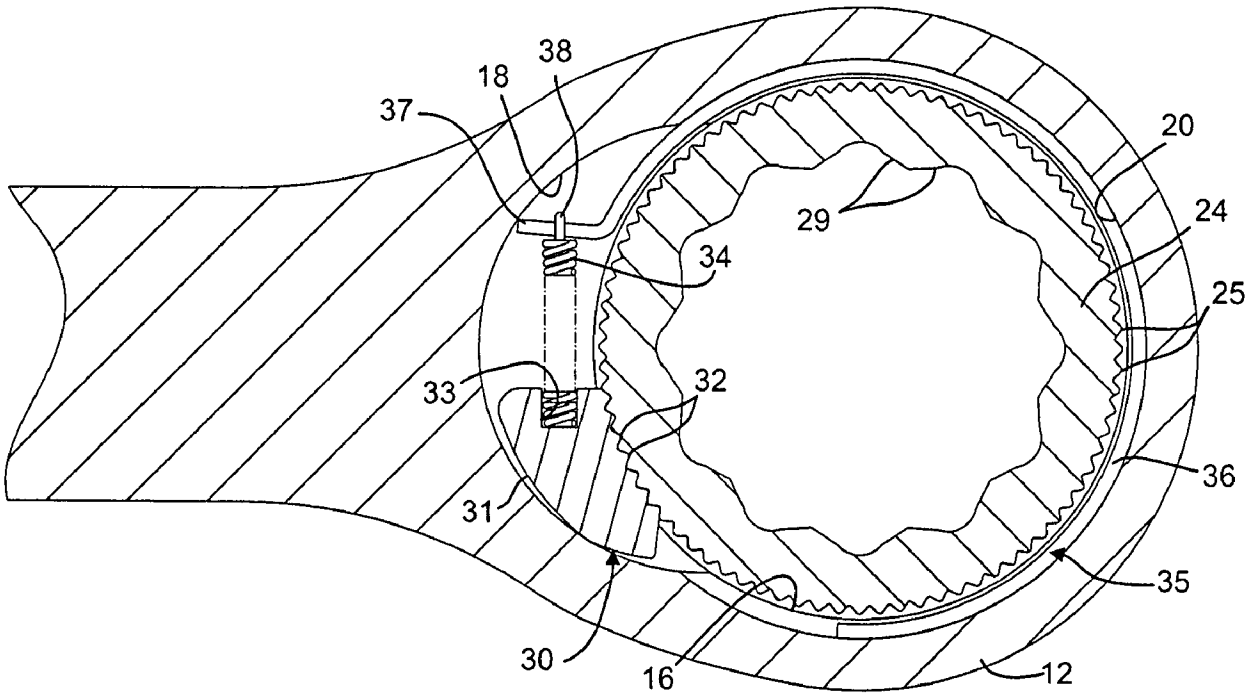
FIG. 4 is a sectional view taken generally along the line 4—4 in FIG. 3.

The ratchet mechanism 22 also includes a pawl 30, which is disposed in use in the lobe 18, the pawl having an arcuate outer surface 31 which generally follows the contour of the peripheral wall of the lobe 18, and a plurality of teeth 32 disposed facing the gear 23. Formed in one end of the pawl 30 is a socket 33 (FIG. 4) receiving one end of a helical compression spring 34. It can be seen that the pawl 30 is generally wedge-shaped, the spring 34 being disposed so as to resiliently urge the pawl 30 toward the narrow end of the lobe 18, so as to generally urge the pawl 30 into wedging engagement between the gear 23 and the sidewall of the lobe 18, as can be seen in FIG. 4, all in a known manner. Thus, the pawl teeth 32 are resiliently urged into meshing engagement with the gear teeth 25.

The spring 34 is retained in place by a retaining clip 35, which has a part-circular portion 36 disposable in the groove 20 and having a tab portion 37 at an end thereof which extends laterally outwardly into the lobe 18 of the cavity 19 and engages a bent coil 38 of the spring 34. It will be appreciated that the tab portion 37, which may engage the peripheral wall of the lobe 18, serves as an anchor against which the spring 34 bears.

Figure 3:
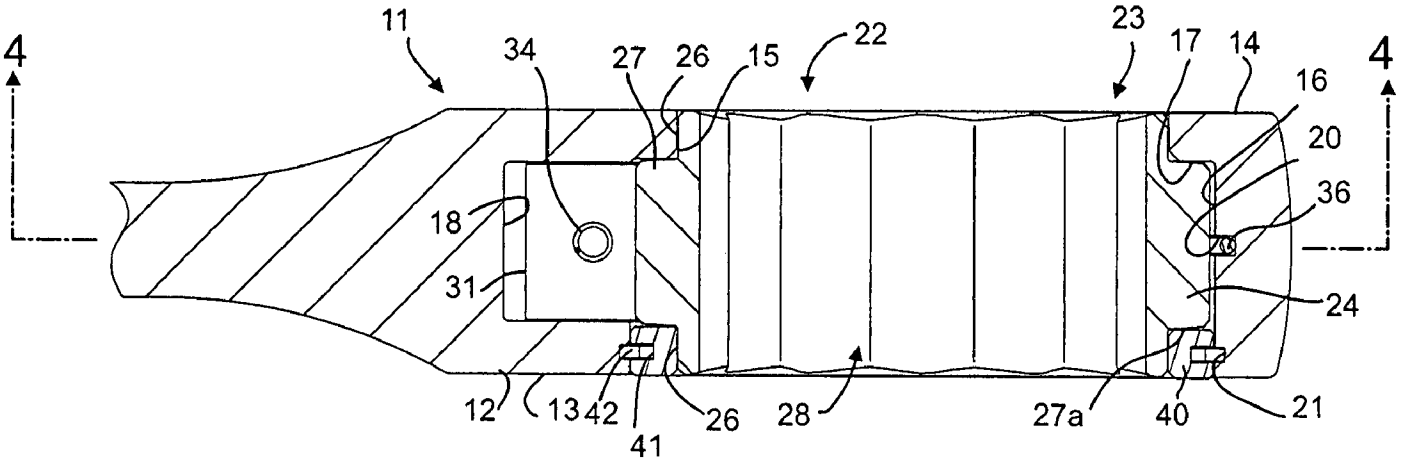
FIG. 3 is an enlarged, fragmentary sectional view taken generally along the line 3—3 in FIG. 1.

The ratchet mechanism 22 is retained in place by an annular cover plate 40, which is dimensioned to seat in the open end of a counterbore 16 in opposed facing relationship with the upper shoulder 27*a* of the gear 23. The cover plate 40 has a circumferential groove 41 in its outer surface (FIG. 3) which receives a snap ring 42, which is dimensioned to also be received in the groove 21 in the body 12 for retaining the cover plate 40 in place, and, thereby, retaining the ratchet mechanism 22 in place. It can be seen that the cover plate 40 cooperates with the shoulder 17 of the body 12 to serve as bearings for the pawl 30, all in a known manner.

The gear teeth 25 and pawl teeth 32 are arranged so that, when the gear 23 is engaged with an associated workpiece, when the wrench 10 is rotated in one direction about the rotational axis of the gear 23, the pawl teeth 32 will be urged more firmly into meshing engagement with the gear teeth 25 for imparting torque to the associated workpiece and, when the wrench is rotated in the opposite direction, the pawl teeth 32 will ratchet past the gear teeth 25, this movement being accommodated by the spring 34, to permit the wrench head 11 to be repositioned rotationally relevant to the workpiece, all in a known manner.

While the recess or groove 20 for the retaining clip 35 is disposed in the body 12, this need not necessarily be the case. For example, it would be possible to form the groove in the gear 23, thereby dividing the gear teeth 25 into axially spaced-apart sections. Also, while the recess is shown in the nature of a groove 20, it will be appreciated that other arrangements could be possible. For example, a further counterbore could be formed in the bore 15 defining a shoulder upon which the retaining clip 35 could be seated. While the ratchet head 11 is a unidirectional ratchet, it will be appreciated that the general principles of the invention would be applicable to bi-directional or reversible ratchets.

The ratchet head 11 and parts of the ratchet mechanism 22 may be formed of suitable metals or other materials commonly used in ratchet mechanisms.

In view of the foregoing, it can be seen that there has been provided a ratchet tool which has an improved pawl spring retention, while being characterized of ease of assembly and simplicity and economy of construction, the parts being easily and inexpensively machineable.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A ratchet tool comprising:

a ratchet body having a cavity therein, a ratchet gear disposed in the cavity, a pawl disposed in the cavity for engagement with the gear, a bias spring disposed for resiliently urging the pawl into engagement with the gear, a recess formed in one of the body and the gear, and a retaining member disposed in the recess between the gear and the body and around the gear, said retaining member engaging the spring for retaining the spring in place.

2. The tool of claim 1, wherein the recess is formed in the body.

3. The tool of claim 2, wherein the body has opposed end faces, the recess being formed in one of the end face.

4. The tool of claim 2, wherein the body has opposed end faces, the recess being formed intermediate the end faces.

5. The tool of claim 2, wherein the recess is part-annular in shape.

6. The tool of claim 1, wherein the retaining member is a spring-like member.

7. The tool of claim 6, wherein the retaining member includes a part-circular portion.

8. The tool of claim 7, wherein the retaining member includes a tab portion projecting laterally outwardly from the part-circular portion.

9. The tool of claim 8, wherein the cavity has a lobe portion, the pawl and the bias spring and the tab being disposed in the lobe portion.

10. A ratchet tool comprising:

a ratchet body having a cavity therein, a ratchet gear disposed in the cavity, a pawl disposed in the cavity for engagement with the gear, a clip disposed in the cavity and around the gear, and a bias spring disposed between the pawl and the clip for resiliently biasing the pawl into engagement with the gear.

11. The tool of claim 10, wherein the clip includes a part-circular portion.

12. The tool of claim 11, wherein the clip includes a tab portion projecting laterally outwardly from the part-circular portion.

13. The tool of claim 12, wherein the cavity has a lobe portion, the pawl and the bias spring and the tab being disposed in the lobe portion.

14. A method of retaining a pawl spring in a ratchet tool having a body with a cavity therein and a ratchet gear in the cavity, the method comprising:

providing a recess in one of the body and the gear; and disposing a retaining member in the recess between the gear and the body and around the gear, said retaining member in engagement with the spring for holding the spring against the pawl to resiliently urge the pawl into engagement with the gear.

15. The method of claim 14, and further comprising providing the recess in the body.

16. The method of claim 14, wherein the retaining member is disposed around the gear.

17. In a ratchet tool having a body with a cavity and a ratchet gear and a pawl disposed in the cavity for engagement with each other and a bias spring disposed in the cavity, the improvement comprising:

a clip disposed in the cavity around the gear for engagement with the bias spring to hold the bias spring against the pawl for resiliently biasing the pawl into engagement with the gear.

18. The tool of claim 17, wherein the clip includes a part-circular portion.

19. The tool of claim 18, wherein the clip includes a tab portion projecting laterally outwardly from the part-circular portion.

* * * * *